US007618036B2

(12) United States Patent
Ikeda

(10) Patent No.: US 7,618,036 B2
(45) Date of Patent: Nov. 17, 2009

(54) PAPER FEED UNIT, PAPER SEPARATING UNIT, AND IMAGE FORMING APPARATUS

(75) Inventor: Akihiro Ikeda, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 407 days.

(21) Appl. No.: 11/249,447

(22) Filed: Oct. 14, 2005

(65) Prior Publication Data

US 2006/0082043 A1 Apr. 20, 2006

(30) Foreign Application Priority Data

Oct. 14, 2004 (JP) ..... 2004-300393

(51) Int. Cl.
*B65H 3/52* (2006.01)

(52) U.S. Cl. ..... 271/121; 271/167; 271/124

(58) Field of Classification Search ..... 271/10.14, 271/16, 19, 124, 126, 121
See application file for complete search history.

(56) References Cited

U.S. PATENT DOCUMENTS 4,305,577 A * 12/1981 Clay et al. ..... 271/119
4,674,737 A * 6/1987 Murayoshi ..... 271/124
4,844,437 A * 7/1989 Tanaka et al. ..... 271/124
4,978,115 A * 12/1990 Sato et al. ..... 271/124
5,058,877 A * 10/1991 Fujiwara et al. ..... 271/124
5,104,113 A * 4/1992 Kameyama et al. ..... 271/124
5,163,668 A * 11/1992 Winship et al. ..... 271/121
5,573,338 A * 11/1996 Morikawa et al. ..... 400/611
5,653,433 A * 8/1997 Ishizuka ..... 271/121
5,671,466 A 9/1997 Hokamura et al.
5,823,524 A * 10/1998 Kawada ..... 271/124
5,938,355 A 8/1999 Suzuki et al.
6,318,716 B1 * 11/2001 Okuda ..... 271/121
6,371,477 B1 * 4/2002 Lin ..... 271/121
6,485,014 B1 * 11/2002 Lin ..... 271/121
6,536,759 B1 * 3/2003 Takada ..... 271/125
6,540,221 B2 * 4/2003 Nakashima et al. ..... 271/121
6,585,250 B1 * 7/2003 Hsiao ..... 271/121
6,672,580 B2 * 1/2004 Shibata et al. ..... 271/124

(Continued)

FOREIGN PATENT DOCUMENTS

JP 05186081 A * 7/1993

(Continued)

*Primary Examiner*—Patrick H Mackey
*Assistant Examiner*—Howard Sanders
(74) *Attorney, Agent, or Firm*—Banner & Witcoff, Ltd

(57) ABSTRACT

A paper feed unit, which is provided with a paper feed roller disposed such that an outer circumferential surface thereof contacts stacked sheets of paper so as to feed each sheet of paper by rotating, a separating pad having elasticity configured to press a sheet of paper being forwarded by the paper feed roller against the outer circumferential surface of the paper feed roller from a side of the sheet of paper opposite to the other side contacting the outer circumferential surface of the paper feed roller, a holder that supports the separating pad, and a biasing device that biases the holder so as to press the separating pad against the outer circumferential surface of the paper feed roller, for separating each sheet of paper from the stacked sheets by the rotation of the paper feed roller in cooperation with the separating pad and thus feeding the sheet of paper.

21 Claims, 10 Drawing Sheets

U.S. PATENT DOCUMENTS

| | | | | |
|---|---|---|---|---|
| 7,497,432 | B2 * | 3/2009 | Ikeda | 271/121 |
| 2003/0062668 | A1 * | 4/2003 | Shibata et al. | 271/121 |
| 2003/0085509 | A1 * | 5/2003 | Chiang | 271/124 |
| 2005/0200071 | A1 | 9/2005 | Ikeda | |

FOREIGN PATENT DOCUMENTS

| | | | | |
|---|---|---|---|---|
| JP | 06321375 | A | * | 11/1994 |
| JP | 07033274 | A | * | 2/1995 |
| JP | 09040190 | A | * | 2/1997 |
| WO | 2005-255385 | | | 9/2005 |

* cited by examiner

PAPER FEED UNIT, PAPER SEPARATING UNIT, AND IMAGE FORMING APPARATUS

CROSS-REFERENCE TO RELATED APPLICATION

This application claims priority under 35 U.S.C. §119 from Japanese Patent Application No. 2004-300393, filed on Oct. 14, 2004. The entire subject matter of the application is incorporated herein by reference.

BACKGROUND

1. Technical Field

Aspects of the present invention relate to a paper feed unit that separates a sheet of paper from a plurality of sheets of paper stacked in a paper tray of a facsimile apparatus, a printer, a copying apparatus or the like and feeds the separated sheet of paper one by one. Aspects of the present invention also relate to a paper separating unit included in the paper feed unit, and to an image forming apparatus in which the paper feed unit is incorporated.

2. Description of Related Art

The paper feed units being currently used include a type that separates a sheet of paper from a plurality of sheets of paper stacked in a paper tray, using friction provided by a paper feed roller and a separating pad (or separating piece) that presses the back surface of the paper against an outer circumferential surface of the paper feed roller, thus to feed the separated paper one by one.

More specifically, the paper feed roller is disposed such that an outer circumferential surface thereof contacts at least the topmost paper of the plurality of sheets of paper stacked in the paper tray, so that, when the paper feed roller rotates, the topmost paper is sent forward. The separating pad is supported by a holder, and the holder is biased toward the paper feed roller by a coil spring or the like, so that the separating pad is pressed against the outer circumferential surface of the paper feed roller. Under such structure, though a plurality of sheets of paper is forwarded by the rotation of the paper feed roller toward the contact interface between the separating pad and the paper feed roller, only one sheet of paper is separated and forwarded according to mutual relationship (in magnitude) of frictional forces acting between the outer circumferential portion of the paper feed roller and the paper, between the sheets of paper, and between the paper and the separating pad.

The paper feed unit thus designed is incorporated in various image forming apparatuses such as facsimile apparatuses, printers, copying apparatuses and so on, to feed the sheets of paper one by one to an image forming unit.

With the foregoing paper feed unit however, the paper feed roller causes a plurality of sheets of paper to move forward out of the paper tray, whereas normally each of the sheets of paper is separated by the interaction of the sheets of paper with the separating pad. However, when a large number (for example more than 10 sheets) of sheets of paper are forwarded and rush to the separating pad at a time, the separating pad may be parted from the paper feed roller by the thickness of the sheets of paper, thereby resulting in the feeding of a plurality of unseparated sheets of paper at a time. This is referred to as a "double feed".

To eliminate such a problem, a structure of the holder and the separating pad that allows the separating pad to elastically deform (recede toward the holder) when many sheets of paper rush to the separating pad has been proposed. The structure operates so as to deposit the sheets of paper in a space created by the elastic deformation and thus to prevent the double feed, as disclosed in Japanese Patent Provisional Publication No. 2005-255385 (hereafter, referred to as JP 2005-255385).

FIG. 7 illustrates the paper feed unit according to JP 2005-255385. The paper feed unit 100 is designed such that a plurality of sheets of paper 104 stacked in a paper tray 102 is individually forwarded by rotation (counterclockwise in FIG. 7) of a paper feed roller 106. The sheets of paper 104 in the paper tray 102 are butted to a contact surface of a paper stage 108 downwardly inclined toward the paper feed roller 106, and hence the sheets of paper 104 tend to intrude between the paper stage 108 and the paper feed roller 106 by the papers' own weight. Here, the front edge (closer to the paper feed roller 106) of the paper stage 108 is farther ahead of the outer circumferential surface of the paper feed roller 106 by a gap a, when viewed from an upstream side in the paper feed direction as shown in FIG. 10. Accordingly, the sheets of paper 104 stacked in the paper tray 102 stop once between the paper stage 108 and the paper feed roller 106. The paper feed roller 106 is caused to rotate when a driving force of a motor (not shown) is transmitted to the rotating shaft of the paper feed roller.

Below the paper feed roller 106, a paper separating unit including a holder 110 that supports a separating pad 112 which is mounted thereon. The holder 110 can swing about a swinging fulcrum P, and is biased by a coil spring 116 so as to press the separating pad 112 against the outer circumferential surface of the paper feed roller 106. The holder 110 includes a recessed portion 114 located on an upstream side in the feed direction, and the separating pad 112 has a predetermined region thereof on a downstream side in the feed direction supported by a supporting base 110*a*, and an end portion on an upstream side in the feed direction supported by an upper end supporter 110*b*.

With the paper feed unit 100 thus configured, normally the paper 104 is forwarded as shown in FIGS. 8A to 8D. Referring first to FIG. 8A, when the sheets of paper 104 are stacked in the paper tray 102, the sheets of paper 104 are orderly placed between the paper stage 108 and the paper feed roller 106 because of the sheets of paper 104*s*' own weight. Once the paper feed roller 106 starts to rotate under this state, a plurality of sheets of paper 104 rush to the separating pad 112 as shown in FIG. 8B. Accordingly, the plurality of sheets of paper 104 is induced to intrude between the separating pad 112 and the paper feed roller 106, however as shown in FIG. 8C, the separating pad 112 recedes toward the recessed portion 114, so that the plurality of sheets of paper 104 is detained in a space created by the receding motion, though the holder 110 itself does not swing. The sheets of paper 104 thus detained by the separating pad 112 are separated into each individual sheet by the rotation of the paper feed roller 106, thus to be forwarded one by one.

However, in the case where a larger (unexpected) number of sheets of paper 104 are forwarded toward the separating pad 112, such as when a frictional force between the sheets of paper 104 is excessively large or when the sheets of paper 104 are improperly set by a user so that an excessive amount of sheets of paper 104 are in contact with the paper feed roller 106, some of the many sheets of paper 104 may directly contact the holder 110, thus causing the holder 110 to swing, by which the separating pad 112 is separated from the paper feed roller 106.

FIGS. 9A to 9D illustrate the details of such phenomenon. When the paper feed roller 106 rotates to start feeding the sheets of paper 104 (FIG. 9A), if an unexpected number of sheets of paper 104 are fed at a time, a part of those sheets of paper directly contacts the holder 110 as shown in FIG. 9B. If the paper feed roller 106 continues to rotate so as to feed the sheets of paper 104 into a narrower location (the contact interface between the separating pad 112 and the paper feed roller 106), the load being applied to the sheets of paper 104 increases and hence the frictional force between the sheets of paper also increases. This applies an unexpectedly heavy load to the holder 110, by which the holder 110 is caused to swing, thus separating the separating pad 112 from the paper feed roller 106 as shown in FIG. 9*c*.

When a gap is thus created between the separating pad 112 and the paper feed roller 106, the conventional problem is reproduced, as the sheets of paper are double-fed without being separated into each sheet. This problem is also incurred when the sheets of paper 104 are butted to a region that is difficult or impossible to be elastically deformed by the weight of the sheets of paper, such as the region on the separating pad 112 supported by the upper end supporter 110*b*, in addition to a case where the sheets of paper 104 are directly butted to the holder 110. In other words, when the sheets of paper 104 are butted to the separating pad 112 at a position that does not cause the separating pad 112 to recede (elastically deformed toward the recessed portion 114), the large load of the sheets of paper 104 is directly applied to the holder 110, and resultantly the holder 110 is caused to swing.

As already seen in FIG. 10, since the front edge (closer to the paper feed roller 106) of the paper stage 108 is farther ahead of the outer circumferential surface of the paper feed roller 106 by the gap α, a central portion of the sheets of paper 104 slightly swells toward the paper tray 102 when the sheets of paper are fed by the paper feed roller 106. This is another factor that induces the sheets of paper 104 to be directly butted to the holder 110.

SUMMARY

Aspects of the invention are advantageous in that they provide at least one of a paper feed unit that can separate each sheet of paper when feeding the sheets of paper, thus preventing the double feed situation more reliably, and a paper separating unit that constitutes such a paper feed unit, and an image forming apparatus in which the paper feed unit is incorporated is provided.

BRIEF DESCRIPTION OF THE ACCOMPANYING DRAWINGS

DETAILED DESCRIPTION

General Overview

Figure 1:
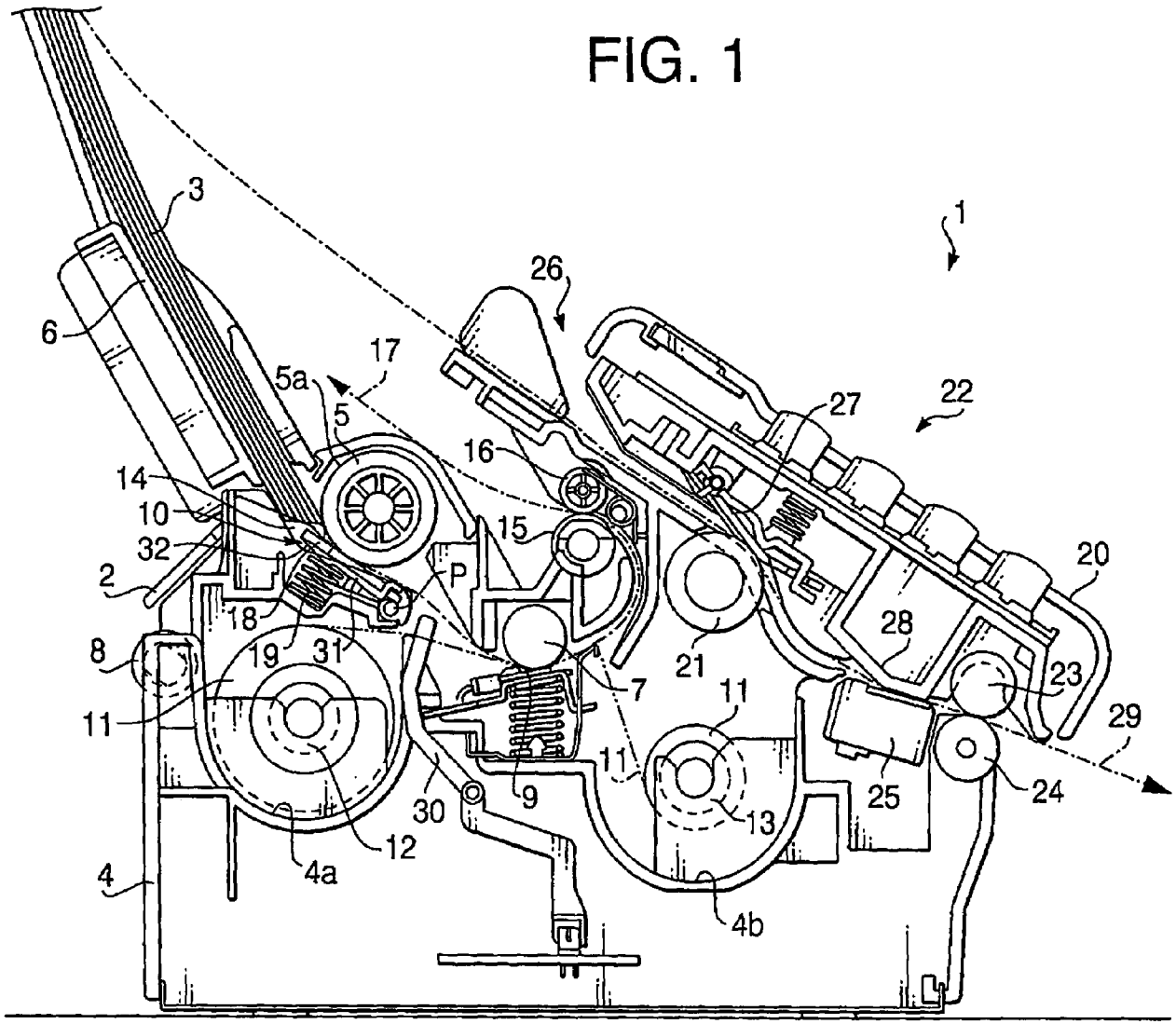
FIG. 1 is a lateral cross-sectional view showing a general structure of a facsimile apparatus in accordance with aspects of the present invention.

According to an aspect of the invention, there is provided a paper feed unit, which is provided with a paper feed roller disposed such that an outer circumferential surface thereof contacts stacked sheets of paper so as to feed each sheet of paper by rotating, a separating pad having elasticity configured to press a sheet of paper being forwarded by the paper feed roller against the outer circumferential surface of the paper feed roller from a side of the sheet of paper opposite to the other side contacting the outer circumferential surface of the paper feed roller, a holder that supports the separating pad, and a biasing device that biases the holder so as to press the separating pad against the outer circumferential surface of the paper feed roller, for separating each sheet of paper from the stacked sheets by the rotation of the paper feed roller in cooperation with the separating pad and thus feeding the sheet of paper. Further, the holder includes a first holder member that supports at least a part of a region on the separating pad from a predetermined position shifted by a predetermined distance from a contact position, at which the separating pad contacts the outer circumferential surface of the paper feed roller, toward an upstream side in a paper feed direction, to an end portion on a downstream stream side in the paper feed direction, and a second holder member that supports at least an end portion of the separating pad on an upstream side in the paper feed direction or the vicinity of the upstream-side end portion of the separating pad. In this structure the biasing devices biases the first holder member. The second holder member is configured to be elastically deformable so as to support elastically the separating pad.

With such structure, the separating pad is supported at least by the first holder member and the second holder member, the latter of which elastically supports the separating pad. Accordingly, when the perpendicular load is applied to the upstream-side end portion or the vicinity thereof of the separating pad, the elasticity of the second holder member absorbs the load. Meanwhile, a part or the whole of the region on the separating pad from the specific position to the downstream-side end portion in the feed direction is supported by the first holder member, which is biased toward the paper feed roller by the biasing device. Therefore, though the upstream-side end portion or the vicinity thereof of the separating pad is caused to though the contact between the pad surface and the paper feed roller is maintained.

Therefore, although a large number of sheets of paper are forwarded by the paper feed roller such that the sheets of paper are directly butted to the upstream-side end portion or the vicinity thereof of the separating pad, the elasticity of the second holder member absorbs the load of the sheets of paper, thereby eliminating the likelihood that the separating pad is separated from the paper feed roller. Consequently, the double feed can be prevented.

Optionally, the second holder member may elastically support the separating pad so as to allow the upstream-side end portion of the separating pad to perpendicularly swing with respect to a surface of the separating pad in contact with the outer circumferential surface of the paper feed roller.

The expression of "perpendicularly swing with respect to the pad surface" herein means that the swinging direction includes a perpendicular component with respect to the pad surface, without limitation to the strict literal meaning.

Still optionally, the holder may include a space in which a predetermined region of the separating pad from the upstream-side end portion to the predetermined position is disposed so as to float, when the separating pad is attached to the holder.

With this configuration, when the sheets of paper contact the surface of the predetermined region of the separating pad, the separating pad recedes into the space because of the load of the sheets of paper. Accordingly, though a plurality of sheets of paper is induced to intrude between the separating pad and the paper feed roller, those sheets of paper are detained in the space created by the receding motion of the separating pad, and then separated into each individual sheet by the rotation of the paper feed roller. Consequently, the double feed can be more effectively prevented.

The second holder member that elastically supports the separating pad could be constituted of a rigid member that directly retains the separating pad and a coil spring or the like that elastically supports the rigid member. However, assembling thus a plurality of independent components to build the second holder member results in an increase in the number of parts, and hence to an increase in dimensions of the paper feed unit and in manufacturing cost thereof. For this reason, optionally, the second holder member may include an elastic member having elasticity in a perpendicular direction with respect to the surface of the separating pad.

Accordingly, the second holder member is constituted of an elastic material having elasticity in a perpendicular direction with respect to the pad surface. The second holder member configured as above is of a simplified structure and hence can be made smaller in dimensions. Such structure leads to reduction in dimensions as well as in manufacturing cost of the paper feed unit as a whole.

Still optionally, the second holder member may include a supporting portion on which the separating pad is placed, and a hook portion located close to the upstream-side end portion of the separating pad, and perpendicularly erected with respect to the surface of the separating pad so as to cover the upstream-side end portion. In this case, the hook portion may have a bent portion which is bent from the perpendicular orientation toward a downstream side in the feed direction and is bent in a predetermined curvature radius, or have an inclined portion that defines a predetermined angle with respect to the surface of the separating pad.

Such structure prevents the sheets of paper from being detained before being butted to the separating pad, to thereby smoothly conduct the sheets of paper to a downstream side in the feed direction. In addition, though the paper feed unit may be turned upside down with the separating pad attached to the second holder member, for example during the assembly of the paper feed unit, at least the upstream-side end portion of the separating pad can be prevented from being detached (or even falling off) from the second holder member, since the hook portion serves to support the separating pad.

The first holder member and the second holder member may be independently attached to the paper feed unit. However, the second holder member may be fixed to the first holder member.

It is preferable that the separating pad is normally supported so as to remain flat. However, if the first holder member and the second holder member are independently attached, the separating pad may be improperly positioned and hence does not stay flat (in other words, fixed in a slightly curved shape). Accordingly, fixing the second holder member to the first holder member as described above achieves a unified structure of the holder, thereby assuring the correct positioning of the separating pad.

Still optionally, the second holder member may include a leaf spring having elasticity in a perpendicular direction with respect to the surface of the separating pad.

The second holder member configured as above is of a simplified structure and hence can be made smaller in dimensions. Such structure leads to reduction in dimensions as well as in manufacturing cost of the paper feed unit as a whole. Also, the leaf spring has, while being basically an elastic material, a certain rigidity (in a direction different to the elastically deforming direction). Therefore the second holder member can be made relatively thinner, while maintaining a sufficient rigidity to bear the load of a plurality of sheets of paper. Such advantage becomes more prominent by employing a leaf spring made of a metal.

In an example, the leaf spring may be fixed to the first holder member at an end portion thereof, and includes two plate-shaped supporting arms extending from the end portion to an upstream side in the paper feed direction toward the upstream-side end portion of the separating pad, and the two plate-shaped supporting arms may be generally symmetrically disposed with respect to a symmetry axis of the separating pad in the paper feed direction.

To be more detailed, while the leaf spring serving as the second holder member supports the separating pad at least at the upstream-side end portion or the vicinity thereof, the leaf spring itself is fixed to the first holder member via the two plate-shaped supporting arms constituting the leaf spring. The two plate-shaped supporting arms are, when viewed from the upstream-side end portion of the separating pad, respectively extended to a downstream side in the paper feed direction, thus to be fixed to the first holder member at the downstream-side end portion in the feed direction. Consequently, since the leaf spring is fixed to the first holder member via the two plate-shaped supporting arms (fixed at two positions), the load of the sheets of paper applied to the separating pad or directly to the leaf spring is evenly distributed to the two plate-shaped supporting arms. Such structure, therefore, stably supports the separating pad.

Still optionally, the first holder member may be made of a resin.

The first holder member may be constituted of various materials as far as the material can support the separating pad and be biased by the biasing device so as to press the separating pad against the paper feed roller. Among such materials, a resin may be employed, because of ease and simplicity in forming and processing. Besides, when the paper feed unit is designed such that the paper that has passed over the separating pad makes contact with the first holder member while being forwarded, the first holder member made of a resin facilitates the paper to smoothly pass through the paper feed unit despite moving in contact with the first holder member.

Meanwhile, in the case where a user of the paper feed unit forcibly pulls the paper, for example when the sheets of paper are jammed, the separating pad may be deformed so as to be peeled off from the first holder member. In such a case, the paper separating performance of the separating pad is degraded and thereby the double feed is provoked. A ninth aspect of the present invention provides a solution for such a problem.

For this reason, the first holder member may include a supporting base on which the separating pad is placed, and the separating pad may be adhesively attached to the supporting base, directly or via a film type material that serves to enhance rigidity of the separating pad.

With this configuration, since the separating pad is adhesively attached to the supporting base, the separating pad can be prevented from being peeled off from the supporting base. Also, when the film type material is provided between the separating pad and the supporting base, the film type material is adhered at least to a region on the separating pad attached to the supporting base. Accordingly, the rigidity of the separating pad can be upgraded without modifying the characteristics of the separating pad (the friction coefficient with respect to the paper, elasticity for the receding motion and so on). Besides, the increase in rigidity of the separating pad further ensures the prevention of the separating pad from being peeled off.

Still optionally, the first holder member may include a swing fulcrum located on a downstream side in the paper feed direction from the contact position of the separating pad and the paper feed roller, so that the first holder member can swing so as to locate the separating pad close to or spaced from the paper feed roller.

In the paper feed unit thus configured, the downstream side in the feed direction from the above contact interface provides a larger room for designing the position of the swing fulcrum, unlike the upstream side where the interference with the paper tray and so forth has to be considered, and hence allows the swing fulcrum to be located sufficiently distant from the contact interface. Such structure minimizes the fluctuation of the separating pad while the sheets of paper are being forwarded there through, thus stabilizing the paper separating performance.

In the case where the swing fulcrum is located on the upstream side in the feed direction, the swing fulcrum has to be located excessively distant from the contact interface in order to avoid the interference with the paper tray and so on, which leads to an increase in dimensions of the paper feed unit as a whole. On the other hand, the paper feed unit configured as mentioned above eliminates such a problem, and is hence effective in making the paper feed unit smaller in dimensions. Besides, when the swing fulcrum is on the downstream side, the friction between the paper and the separating pad provides a momentum in a direction to press the separating pad against the paper. As a result, the paper is more firmly pressed against the separating pad (and hence to the paper feed roller), which further ensures the prevention of the double feed.

According to another aspect of the invention, there is provided a paper feed unit, which is provided with a paper feed roller disposed such that an outer circumferential surface thereof contacts stacked sheets of paper so as to feed each sheet of paper by rotating, a separating pad having elasticity configured to press a sheet of paper being forwarded by the paper feed roller against the outer circumferential surface of the paper feed roller from a side of the sheet of paper opposite to the other side contacting the outer circumferential surface of the paper feed roller, a holder that supports the separating pad, and a biasing device that biases the holder so as to press the separating pad against the outer circumferential surface of the paper feed roller, for separating each sheet of paper from the stacked sheets by the rotation of the paper feed roller in cooperation with the separating pad and thus feeding the sheet of paper. In this structure, the holder has a recessed portion located on an upstream side in a paper feed direction with respect to a contact position at which the separating pad contacts the outer circumferential surface of the paper feed roller so that an upstream-side end portion of the holder can swing with respect to a position of the recessed portion.

With this configuration, although a large number of sheets of paper are forwarded by the paper feed roller such that the sheets of paper are directly butted to the upstream-side end portion or the vicinity thereof of the separating pad, the elasticity of the holder absorbs the load of the sheets of paper, thereby eliminating the likelihood that the separating pad is separated from the paper feed roller. Consequently, the double feed can be prevented.

Optionally, recessed portion is formed on a surface of the holder facing the separating pad so that a space is formed between the separating pad and the recessed portion of the holder.

With this configuration, when the sheets of paper contact the surface of a region of the separating pad, the separating pad recedes into the space because of the load of the sheets of paper. Accordingly, though a plurality of sheets of paper is induced to intrude between the separating pad and the paper feed roller, those sheets of paper are detained in the space created by the receding motion of the separating pad, and then separated into each individual sheet by the rotation of the paper feed roller. Consequently, the double feed can be more effectively prevented.

Still optionally, the recessed portion is formed on a surface of the holder opposite to the other surface facing the separating pad.

Still optionally, the recessed portion may have a thickness smaller than that of the other portion of the holder.

According to another aspect of the invention, there is provided an image forming apparatus, which is provided with the paper feed unit mentioned above, and an image forming unit that forms an image on a sheet of paper fed by the paper feed unit.

In the image forming apparatus thus structured, since the foregoing paper feed unit is incorporated, the double feed of the sheets of paper can be prevented, and hence the sheets of paper are fed to the image forming unit one by one. Therefore, the image forming apparatus that performs excellent paper separation can be obtained.

According to another aspect of the invention, there is provided a paper separating unit used in a paper feed unit having a paper feed roller and a biasing device for separating each sheet of paper from stacked sheets by rotation of the paper feed roller. The paper separating unit is provided with a separating pad having elasticity configured to press a sheet of paper being forwarded by the paper feed roller against an outer circumferential surface of the paper feed roller from a side of the sheet of paper opposite to the other side contacting the outer circumferential surface of the paper feed roller, and a holder that supports the separating pad. The holder includes a first holder member that supports at least a part of a region on the separating pad from a predetermined position shifted by a predetermined distance from a contact position, at which the separating pad contacts the outer circumferential surface of the paper feed roller, toward an upstream side in a paper feed direction, to an end portion on a downstream side in the paper feed direction, and a second holder member that supports at least an end portion of the separating pad on an upstream side in the paper feed direction or the vicinity of the upstream-side end portion of the separating pad, the second holder member being configured to be elastically deformable so as to support elastically the separating pad.

With this configuration, although a large number of sheets of paper are forwarded by the paper feed roller such that the sheets of paper are directly butted to the upstream-side end portion or the vicinity thereof of the separating pad, the elasticity of the second holder member absorbs the load of the sheets of paper, thereby eliminating the likelihood that the separating pad is separated from the paper feed roller. Consequently, the double feed can be prevented.

Optionally, the second holder member may elastically support the separating pad so as to allow the upstream-side end portion of the separating pad to perpendicularly swing with respect to a surface of the separating pad in contact with the outer circumferential surface of the paper feed roller.

According to another aspect of the invention, there is provided a paper separating unit used in a paper feed unit having a paper feed roller and a biasing device for separating each sheet of paper from stacked sheets by rotation of the paper feed roller. The paper separating unit is provided with a separating pad having elasticity configured to press a sheet of paper being forwarded by the paper feed roller against the outer circumferential surface of the paper feed roller from a side of the sheet of paper opposite to the other side contacting the outer circumferential surface of the paper feed roller, and a holder that supports the separating pad. The holder has a recessed portion located on an upstream side in a paper feed direction with respect to a contact position at which the separating pad contacts the outer circumferential surface of the paper feed roller so that an upstream-side end portion of the holder can swing with respect to a position of the recessed portion.

With this configuration, although a large number of sheets of paper are forwarded by the paper feed roller such that the sheetes of paper are directly butted to the upstream-side end portion or the vicinity thereof of the separating pad, the elasticity of the holder absorbs the load of the sheets of paper, thereby eliminating the likelihood that the separating pad is separated from the paper feed roller. Consequently, the double feed can be prevented.

The paper separating unit according to the above mentioned two aspects of the invention can be independently fabricated, used and distributed, and provides beneficial performance in achieving the foregoing advantages, once incorporated in the paper feed unit described above. Also, since the paper separating unit can be separately fabricated apart from the production line of the main portion of the paper feed unit, troubles in handling small-sized components for assembling the paper separating unit can be minimized, and therefore the components can be prevented from being deformed or damaged.

ILLUSTRATIVE EMBODIMENTS

Hereunder, an Illustrative embodiment according to the present invention will be described based on the accompanying drawings. It is noted that various connections are set forth between elements in the following description. It is noted that these connections in general and, unless specified otherwise, may be direct or indirect and that this specification is not intended to be limiting in this respect.

FIG. 1 is a lateral cross-sectional view showing a general structure of a facsimile apparatus, corresponding to an image forming apparatus according to the present invention. As shown in FIG. 1, the facsimile apparatus 1 according to the embodiment includes an upper cover 2 and a lower cover 4. When the right side in FIG. 1 is defined as the front side and the left side as the rear side of the facsimile apparatus 1, a paper tray 6 is located above the upper cover 2 so as to be inclined toward a rear portion of the upper cover 2. In the paper tray 6, the sheets of paper 3, serving as the medium for recording, are set.

Under the paper tray 6 a paper stage 14 is located, so that a lower edge (on a downstream side in the feed direction) of a plurality of sheets of paper 3 is butted to the paper stage 14 when the sheets of paper are set in the paper tray 6. A face of the paper stage 14 to which the lower edge of the sheets of paper 3 is butted is inclined downward toward a paper feed roller 5, so that the sheets of paper 3 set in the paper tray 6 are induced to intrude between the paper stage 14 and the paper feed roller 5, by the self weight of the sheets of paper 3.

Figure 10:
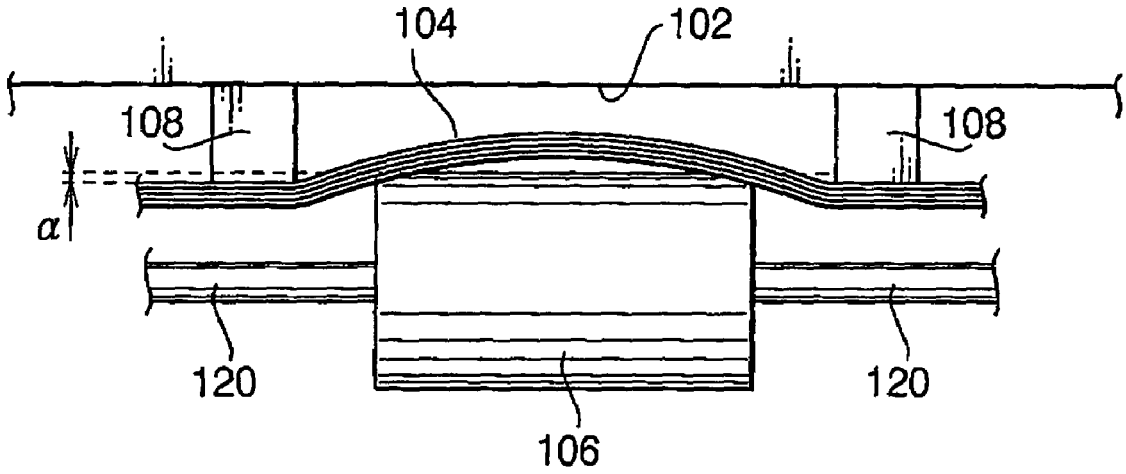
FIG. 10 is a schematic drawing showing a positional relationship between a paper feed roller and a paper stage.

Here, the relative positional relationship between the paper stage 14 and the paper feed roller 5 is similar to that between the paper stage 108 and the paper feed roller 106 shown in FIG. 10, namely the front edge of the paper stage 14 is farther ahead from an outer circumferential surface of the paper feed roller 5 by a predetermined distance (a in FIG. 10), toward the center axis of the paper feed roller 5.

Accordingly, though a large number of sheets of paper 3 are set in the paper tray 6, there is no likelihood that the paper falls down through between the front edge of the paper stage 14 and the paper feed roller 5. Two such paper stages 14 are disposed close to lateral end portions of the paper feed roller 5 respectively, as the paper stage 108 shown in FIG. 10. Therefore the paper stages 14 are kept from interfering with the paper feed roller 5. Under the paper tray 6, also additional paper stages are disposed, though not shown, close to left and right end portions of the facsimile apparatus 1 (in FIG. 10, farther to the left from the left side paper stage 108 and farther to the right from the right side paper stage 108), not only the two paper stages 14 disposed close to the lateral end portions of the paper feed roller 5.

The sheets of paper 3 are conveyed by rollers and so on to be subsequently described, along a paper path 17 indicated by the arrow in FIG. 1. Here, without limitation to the paper 3, various other media such as an OHP sheet may be employed for forming an image thereon.

The upper cover 2 and the lower cover 4 are pivotally connected at the respective rear end portions, via a cover shaft 8. When a user manipulates a lever (not shown) so as to open the upper cover 2, the upper cover 2 rotates counterclockwise in FIG. 1, around the cover shaft 8. This rotating motion causes the paper tray 6 and a mechanism installed on an upper portion of the facsimile apparatus 1 to be described later including the paper feed roller 5, a platen 7, a paper discharge roller 15, an ADF (Automatic Document Feeder) roller 21, a LF (Line Feed) roller 23, and a keyboard 22, to rotate together with the upper cover 2.

The paper feed roller 5 is rotationally driven by a driving force of a motor (not shown) transmitted via a gear mechanism, so as to feed the sheets of paper 3 set in the paper tray 6 one by one along the paper path 17, in cooperation with a separating pad 18. The outer circumferential surface (the surface to be in contact with the paper) 5*a* of the paper feed roller 5 is constituted of a material having a high friction coefficient such as a synthetic rubber.

The separating pad 18 constitutes a paper separating unit 10 in combination with a resin holder 31 and a leaf spring 32. The separating pad 18 has its region on a downstream side in the paper feed direction supported by the resin holder 31, and its region on an upstream side in the feed direction (upstream-side end portion) supported by the leaf spring 32. The resin holder 31 is swingably supported on a swing fulcrum P located at a right side end portion in FIG. 1, so that the separating pad 18 can swing so as to be close to or spaced from the paper feed roller 5. The resin holder 31 is also biased by a coil spring 19 serving as a biasing device. The biasing force causes the surface of the separating pad 18 (pad surface) to be pressed against the outer circumferential surface 5*a* of the paper feed roller 5. The separating pad 18 is constituted of a material having a high friction coefficient such as a silicone rubber.

On a downstream side of the paper feed roller 5 along the paper path 17, the platen 7 is provided. The platen 7 is also rotationally driven by a driving force of a motor (not shown) transmitted via a gear mechanism. Under the platen 7, a printing head 9 is disposed so as to oppose the plate 7, for transferring an ink applied to a ribbon 11 onto the paper 3 thus to form an image thereon. The printing head 9 is constituted of a so-called line thermal head, which includes a multitude of heating elements aligned in a row. Thus the printing head 9 can cover the printing range on the paper 3 employed as a recording medium.

The printing head 9 is fixed in a lower portion of the facsimile apparatus 1 (inside the lower cover 4), together with a ribbon feed case 4*a*, a ribbon winding case 4*b*, a CIS (Contact Image Sensor) 25, a pinch roller 24 for discharging a source document, a ribbon sensor 30 and so forth. Therefore, when the upper cover 2 is opened, the platen 7 is separated from the printing head 9, while the printing head 9 remains immobile. Also, the printing head 9 and the ribbon 11 constitute the image forming unit according to the embodiment.

On a downstream side of the platen 7 along the paper path 17, a paper discharge roller 15 is provided, so as to serve to discharge the paper 3 on which an image has been formed out of the facsimile apparatus 1. Atop the paper discharge roller 15, a paper discharge pinch roller 16 is disposed so as to be pressed thereto.

The paper discharge roller 15 is also rotationally driven by a driving force of a motor (not shown) transmitted via a gear mechanism, so as to convey the paper 3 on which an image has been formed along the paper path 17 in cooperation with the paper discharge pinch roller 16, thus to discharge the paper out of the facsimile apparatus 1.

Meanwhile, a source document with an image to be transmitted is, once inserted into a source document inlet 26, conveyed by the ADF roller 21 and the LF roller 23 along a source document conveying path 29. To be more detailed, when the source document is inserted into the source document inlet 26, the source document is first conveyed by the ADF roller 21. To an upper surface of the ADF roller 21, a separating piece 27 is butted so as to separate a plurality of source documents into each single sheet when conveyed by the ADF roller 21, thus to prevent the double feed. In other words, the ADF roller 21 serves to convey one by one the source documents inserted into the source document inlet 26 along the source document conveying path 29, in cooperation with the separating piece 27.

On a downstream side of the ADF roller 21 along the source document conveying path 29, a CIS 25 is provided, against an upper face of which a source document presser 28 is pressed. The CIS 25 sequentially reads an image on the source document, while the source document conveyed along the source document conveying path 29 passes between the CIS 25 and the source document presser 28.

On a downstream side of the CIS 25, the LF roller 23 and the source document discharge pinch roller 24 pressed against a lower portion of the LF roller 23 are rotatably disposed. The LF roller 23 and the source document discharge pinch roller 24 serve to discharge the source document, the image on which has been read via the CIS 25, out of the facsimile apparatus 1.

An upper panel plate 20 is provided with a keyboard 22 including numeral keys and various function keys. According to an operation of these keys by a user, the facsimile apparatus 1 executes various programmed jobs. The upper panel plate 20 also includes a display unit (not shown) that displays the operational status to the user.

The lower cover 4 is provided with the ribbon feed case 4*a* located below the paper feed roller 5, and the ribbon winding case 4*b* below the ADF roller 21. The ribbon feed case 4*a* accommodates the ribbon 11 wound in a roll around a ribbon feed cylinder 12, and the ribbon 11 passes, upon being drawn out of the ribbon feed case 4*a*, between the platen 7 and the printing head 9, to thereafter be wound on a ribbon winding spool 13 located in the ribbon winding case 4*b*.

In this embodiment, the ribbon feed cylinder 12 and the ribbon winding spool 13 are built in a single ribbon cassette, in which both the cylinder and the spool are attached to a cassette frame (not shown), and such ribbon cassette is removably attached to the lower cover 4. It is to be noted, however, that employing the ribbon cassette is only an example, and that the ribbon feed cylinder 12 and the ribbon winding spool 13 may be separately attached to the lower cover 4 in a removable manner.

The ribbon 11 has a sufficient width to cover the printing range of the heating element of the line thermal head constituting the printing head 9. The ribbon winding spool 13 is rotationally driven by a driving force of a motor (not shown) transmitted via a gear mechanism, to wind the ribbon 11 that has been used for image formation on the paper 3.

In the facsimile apparatus 1 thus configured according to the embodiment, the sheets of paper 3 stacked in the paper tray 6 are individually conveyed by the paper feed roller 5 so as to pass between the platen 7 and the printing head 9, where the ink applied to the ribbon 11 is transferred onto the paper 3 so that an image is formed thereon. The image formation on the paper 3 is performed via the printing head 9, while the platen 7 is rotating and the ribbon wound on the ribbon feed cylinder 12 is being wound on the ribbon winding spool 13. The paper 3 bearing the image thus formed is conveyed upward along the paper path 17, and then discharged by the paper discharge roller 15. The source document bearing the image to be transmitted is conveyed by the ADF roller 21 along the source document conveying path 29 so that the CIS 25 reads out the image, and discharged by the LF roller 23.

Figure 2A:
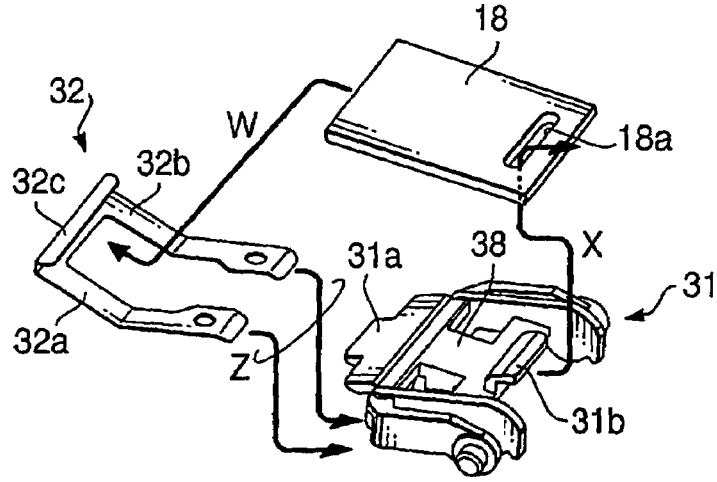
FIG. 2A is an exploded perspective view from an upper direction, 2B an exploded side view and 2C an exploded perspective view from a lower direction, respectively showing a structure of a separating pad, a resin holder and a leaf spring that constitute a paper separating unit in accordance with aspects of the present invention.

Now referring to FIGS. 2A to 2C, the detailed structure of the paper separating unit 10 will be described. FIG. 2A is an exploded perspective view from an upper direction, 2B an exploded side view and 2C an exploded perspective view from a lower direction, respectively showing a structure of a separating pad, a resin holder and a leaf spring that constitute the paper separating unit 10.

As shown in these drawings, the separating pad 18 is a thin plate-shaped member, which includes a slot 18*a* located on a downstream side in the feed direction. On the rear face of the separating pad 18 opposite to the pad surface to be engaged with the paper feed roller 5, a film type material 39 is adhered. The film type material 39 serves to enhance the rigidity of the separating pad 18, and may be made of PET for example. To be more detailed, the separating pad 18 itself is made of an elastic material such as a silicone rubber as already described, and at least a region on the separating pad 18 close the upstream-side end portion has to be elastically deformable, while a region on a downstream side in the feed direction does not necessarily have to be elastically deformed. Accordingly, the film type material 39 serves to enhance the rigidity of such region that does not have to be elastically deformed.

The resin holder 31 (a first holder member) is a member made of a resin that includes a supporting base 38 on which the separating pad 18 is placed, an inclined portion 31*a* downwardly inclined with respect to the supporting base 38 toward an upstream side in the feed direction, and a hook-shaped projection 31*b* perpendicularly erected from the supporting base 38, as shown in FIG. 2A. On the rear face of the resin holder 31 (opposite to the face on which the separating pad 18 is placed), two insertion slots 36, 37 and two fixing projections 34, 35 are provided as shown in FIG. 2C.

The leaf spring 32 (a second holder member) is a member made of a metal that includes two plate-shaped supporting arms 32*a*, 32*b*, a supporting portion 32*f* (FIG. 2B) that supports the upstream-side end portion of the separating pad 18, and a paper guide portion 32*c* that covers the upstream-side end portion of the separating pad 18.

The separating pad 18, the resin holder 31 and the leaf spring 32 thus configured are assembled together thus to constitute the paper separating unit 10. To assemble, firstly the separating pad 18 is placed on the supporting base 38 of the resin holder 31, as indicated by the arrow Y in FIGS. 2B and 2C. In this step, the hook-shaped projection 31*b* of the resin holder 31 is inserted through the slot 18*a* of the separating pad 18, as indicated by the arrow X in FIG. 2A. At this stage, the separating pad 18 is attached in place to the supporting base 38, with the hook-shaped projection 31*b* inserted through the slot 18*a*.

Figure 2B:
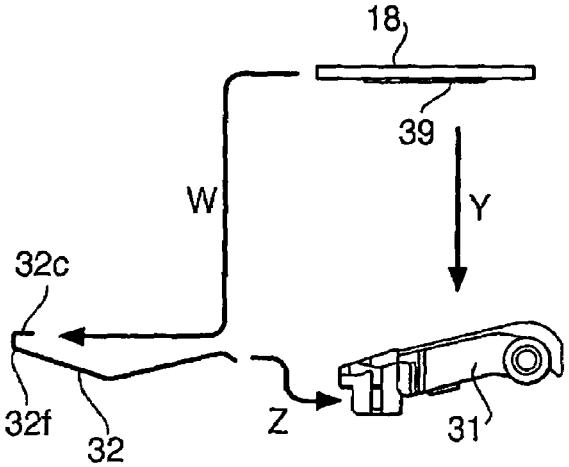
Figure 2C:
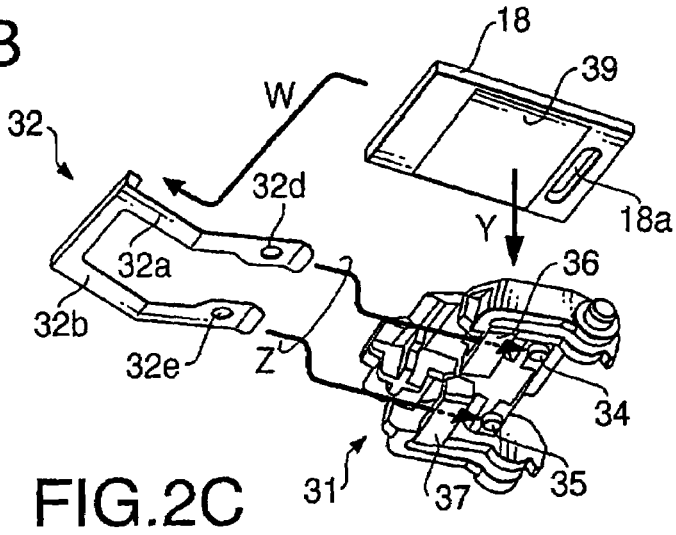

Then the two plate-shaped supporting arms 32*a*, 32*b* constituting the leaf spring 32 are inserted along the lower face of the resin holder 31, as indicated by the arrow Z in FIGS. 2A to 2C. More specifically, as shown in FIG. 2C, one of the plate-shaped supporting arms 32*a* inserted through one of the insertion slots 36 provided on the lower face of the resin holder 31, while the other plate-shaped supporting arm 32*b* is inserted through the other insertion slot 37.

Thereafter, one of the fixing projections 34 formed on the lower face of the resin holder 31 is inserted through one of the fixing holes 32*d* located at a front end portion of the plate-shaped supporting arms 32*a* which has been inserted through the insertion slot 36, so as to fix one of the plate-shaped supporting arms 32*a* to the resin holder 31. Also, the other fixing projection 35 formed on the resin holder 31 is inserted through the other fixing hole 32*e* located at a front end portion of the plate-shaped supporting arm 32*b* which has been inserted through the insertion slot 37, so that the other plate-shaped supporting arm 32*b* is also fixed the resin holder 31.

At this stage, the leaf spring 32 has been fixed to the resin holder 31, thus constituting one unified holder that supports the separating pad 18. Finally, the upstream-side end portion of the separating pad 18 is placed on the supporting portion 32*f* so as to be covered with the paper guide portion 32*c* of the leaf spring 32, as indicated by the arrow W in to 2C.

The foregoing assembly method is only exemplary and, for example, the separating pad 18 may be placed after assembling the resin holder 31 and the leaf spring 32. As long as the paper separating unit 10 is eventually obtained, the assembly method is not specifically limited.

Figure 3A:
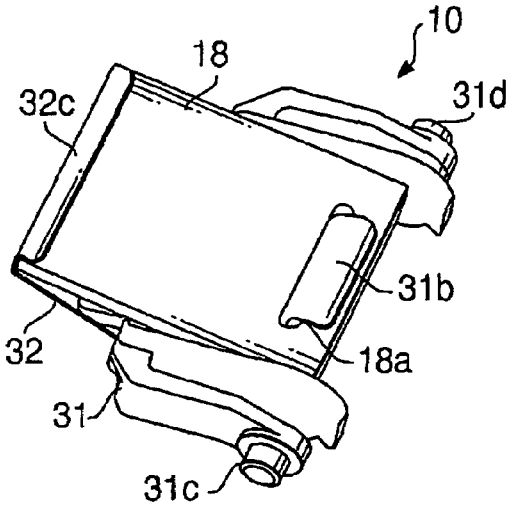
FIG. 3A is a perspective view, 3B a plan view, 3C a side view, 3D a bottom view and 3E a cross-sectional view taken along the line A-A of FIG. 3D, respectively showing a structure of a paper separating unit in accordance with aspects of the present invention.
Figure 3D:
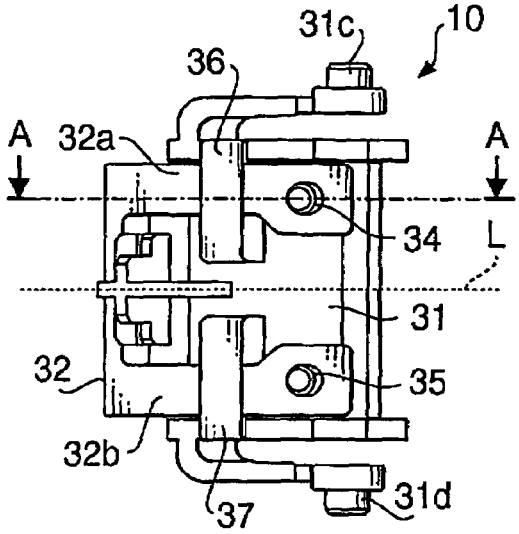

FIGS. 3A to 3E depict the paper separating unit 10 built by assembling the separating pad 18, the resin holder 31 and the leaf spring 32, among which FIG. 3A is a perspective view, 3B a plan view, 3C a side view, 3D a bottom view and 3E a cross-sectional view taken along the line A-A of FIG. 3D, respectively showing the structure of the paper separating unit 10.

Figure 3B:
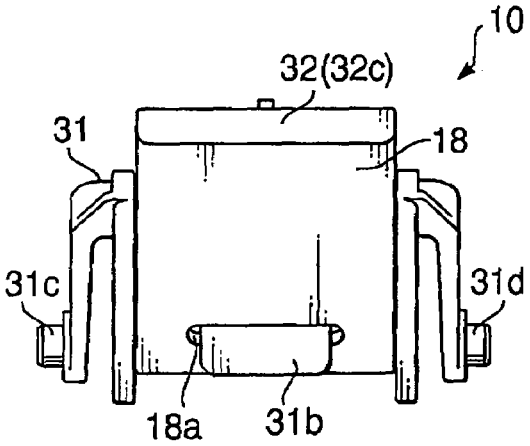

As shown in FIGS. 3A and 3B, the hook-shaped projection 31*b* formed on the resin holder 31 is inserted through the slot 18*a* of the separating pad 18. The upstream-side end portion of the separating pad 18 is covered with the paper guide portion 32*c* of the leaf spring 32. Also, the resin holder 31 includes swing shafts 31*c*, 31*d* respectively located at the lateral end portions, so that when the paper separating unit 10 is incorporated in the facsimile apparatus 1 the swing shafts 31*c*, 31*d* serve as the fulcrum that supports the resin holder 31 allowing a swinging motion thereof (and hence swingably supports the entire paper separating unit 10). Accordingly, the center of axis of the swing shafts 31*c*, 31*d* corresponds to the swing fulcrum P shown in FIG. 1.

Now, the upstream-side end portion of the separating pad 18 is elastically supported by the supporting portion 32*f*, so that the upstream-side end portion or the vicinity thereof of the separating pad 18 can swing perpendicularly with respect to the pad surface. Besides, since the upstream-side end portion is covered with the paper guide portion 32*c*, the paper 3 can be smoothly forwarded.

The paper guide portion 32*c* (a hook portion) is erected on the supporting portion 32*f* perpendicularly with respect to the pad surface, so as to have a lateral cross-section of a reverse L shape. In other words, the metal plate perpendicularly erected as above on the supporting portion 32*f* is bent toward a downstream side in the feed direction so as to cover the pad surface of the separating pad 18.

The bent portion 42 (FIG. 3C) is, to be detailed, bent in a predetermined curvature radius. In other words, the bent portion is of a smooth shape rather than a sharp edge. Accordingly, even though the paper 3 fed from the paper tray 6 are butted to the bent portion 42, the paper 3 can be exempted from being detained, and can therefore be smoothly conducted toward a downstream side in the feed direction.

Figure 3E:
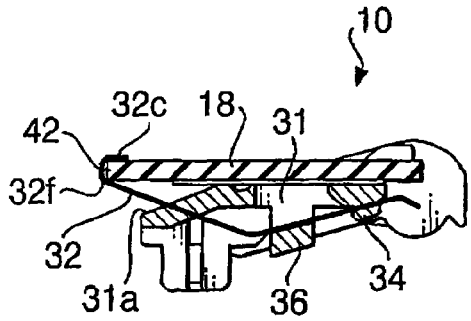
Figure 3C:
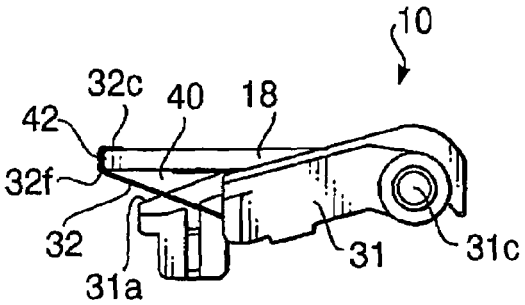

Also, as shown in FIG. 3C, the resin holder 31 includes the inclined portion 31*a* in a region on an upstream side in the feed direction from the supporting base 38 (FIG. 2A), and the plate-shaped supporting arms 32*a*, 32*b* of the leaf spring 32 are also spaced from the rear face of the separating pad 18. Such configuration creates a space 40 under the separating pad 18, over a region from the boundary between the supporting base 38 and the inclined portion 31*a* of the resin holder 31 (a specific position) to the base portion of the supporting portion 32*f* of the leaf spring 32. Accordingly, the separating pad 18 is not directly supported either by the resin holder 31 or by the leaf spring 32 in this region, but in a floating state. Such space 40 provides a room for the separating pad 18 to recede (be elastically deformed) toward the leaf spring 32.

Further, as shown in FIGS. 3D and 3E, the two plate-shaped supporting arms 32*a*, 32*b* constituting the leaf spring 32 are respectively inserted through the insertion slots 36, 37 of the resin holder 31, and the fixing projections 34, 35 formed on the resin holder 31 are respectively inserted through the fixing holes 32*d*, 32*e* (FIG. 2E) located at the front end portion of the plate-shaped supporting arms 32*a*, 32*b*. In addition, the two plate-shaped supporting arms 32*a*, 32*b* are symmetrically located with respect to the symmetry axis L of the separating pad 18 in the feed direction.

Figure 4A:
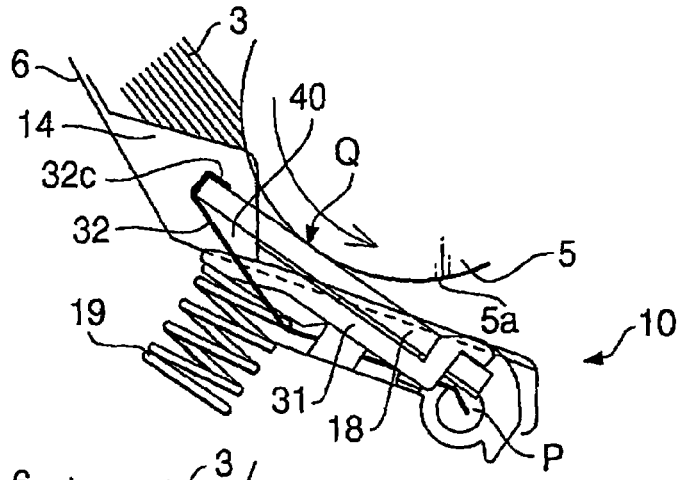
FIGS. 4A to 4D are side views showing a process of a normal paper feed operation in accordance with aspects of the present invention.

Now referring to FIG. 4, a normal paper feeding operation by the facsimile apparatus 1 according to the embodiment will be described hereunder. Referring first to FIG. 4A, when a plurality of sheets of paper 3 are stacked in the paper tray 6, the sheets of paper 3 are orderly placed between the paper stage 14 and the paper feed roller 5 because of the self weight of the sheets of paper 3. This example is, however, based on the assumption that a user has improperly set the sheets of paper 3 in the paper tray 6, thereby causing the sheets of paper 3 to be butted to the outer circumferential surface 5*a* of the paper feed roller 5. Here, the resin holder 31 constituting the paper separating unit 10 is biased by the coil spring 19, so that the pad surface of the separating pad 18 is brought into contact with the outer circumferential surface 5*a* of the paper feed roller 5, at the contact interface Q.

Figure 4B:
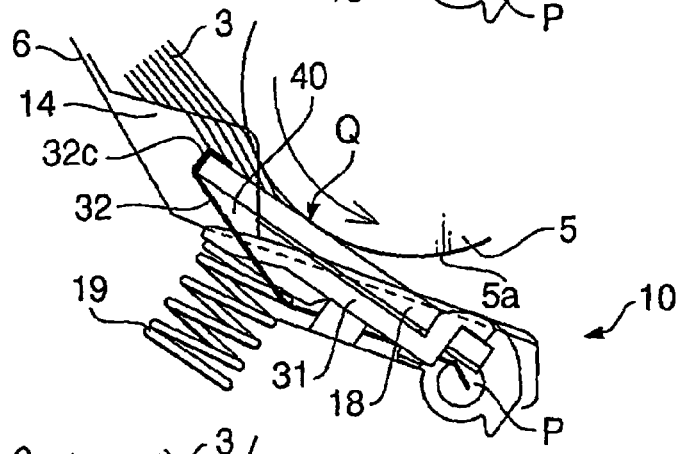

Once the paper feed roller 5 is driven to rotate counterclockwise under such state, an unexpectedly large number of sheets of paper 3 rush to the separating pad 18 as shown in FIG. 4B. As a result, several sheets of paper that are most distant from the paper feed roller 5 among the plurality of sheets of paper 3 are butted to the leaf spring 32 supporting the separating pad 18, instead thereof. To be more detailed, the front edge of the several sheets of paper 3 is butted to the paper guide portion 32*c* of the leaf spring 32.

At this moment, the load of the sheets of paper 3 butted to the paper guide portion 32*c* causes the leaf spring 32 to warp (be elastically deformed). In other words, the load of the sheets of paper 3 is not directly applied to the resin holder 31, but most of the load is absorbed by the elasticity of the leaf spring 32. Therefore, although the leaf spring 32 is elastically deformed, the resin holder 31 is not caused to swing, and thus the separating pad 18 and the paper feed roller 5 can remain pressed against each other.

Figure 4C:
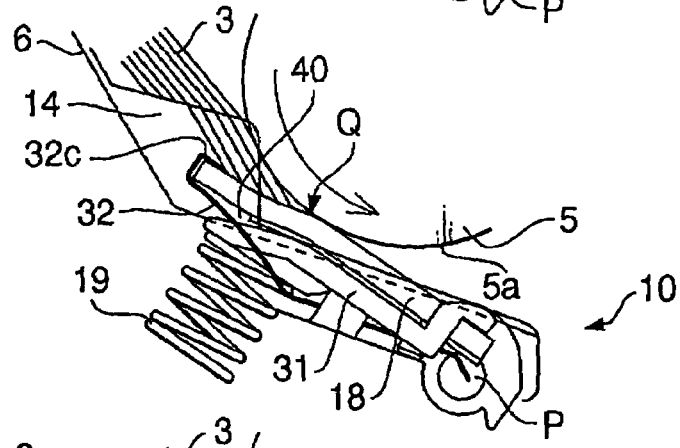
Figure 4D:
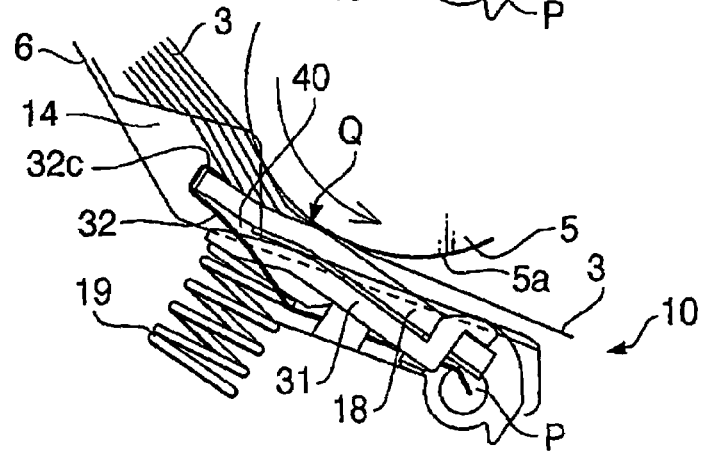

With further rotation of the paper feed roller 5 under such state, the sheets of paper 3 butted to the paper guide portion 32*c* are conducted toward a downstream side in the feed direction by the effect of the bent portion 42 (FIG. 3C), thus to be butted to the pad surface of the separating pad 18 together with the other sheets of paper, as shown in FIG. 4C. Here again, the portion of the separating pad 18 engaged with the sheets of paper 3 recedes toward the space 40 thus keeping the resin holder 31 from swinging, so that the sheets of paper 3 are detained in the recessed region. The plurality of sheets of paper 3 thus detained by the separating pad 18 is separated into each single sheet by further rotation of the paper feed roller 5, to be forwarded one by one as shown in FIG. 4D.

With the facsimile apparatus 1 described in details according to the embodiment, even though an unexpectedly large number of sheets of paper 3 are forwarded to the separating pad 18 and a part of those sheets of paper is directly butted to the leaf spring 32 supporting the separating pad 18, the separating pad 18 and the paper feed roller 5 can remain pressed against each other since the load of the sheets of paper 3 is absorbed in the elasticity of the leaf spring 32. Therefore, the double feed of the sheets of paper 3 can be prevented, and the facsimile apparatus 1 that performs excellent paper separation can be obtained.

Also, under the predetermined region of the separating pad 18 in an upstream side in the feed direction, the space 40 is provided. This allows the separating pad 18 to recede toward the space 40. Accordingly, though a plurality of sheets of paper 3 is induced to intrude between the separating pad 18 and the paper feed roller 5, the sheets of paper 3 are once detained by the recessed region of the separating pad 18, to be thereafter forwarded one by one by the paper feed roller 5. Consequently, the double feed can be more effectively prevented.

Also, the leaf spring 32 made of a metal, capable of swinging (being elastically deformed) perpendicularly with respect to the pad surface, is employed for supporting the upstream-side end portion of the separating pad 18. Since the leaf spring 32 is basically an elastic material yet having a certain rigidity, the leaf spring 32 can be formed to be relatively thin, yet a sufficient rigidity can be assured to bear the load of the plurality of sheets of paper. Employing such a component allows constituting a reliable paper separating unit 10 through a simple process, and reducing the dimensions of the unit as well as the manufacturing cost.

Also, the leaf spring 32 includes the paper guide portion 32*c* including the bent portion 42 formed in the predetermined curvature radius, such that the paper guide portion 32*c* covers the upstream-side end portion of the separating pad 18. Accordingly, even though a large number of sheets of paper 3 are forwarded and a part of them is butted to an end portion of the leaf spring 32, those sheets of paper 3 can be smoothly conducted toward a downstream side in the feed direction, by the effect of the bent portion 42 in the paper guide portion 32*c*.

Also, the paper guide portion 32*c* has a lateral cross-section of a reverse L shape, so as to cover a part of the pad surface. And a region of the separating pad 18 on a downstream side in the feed direction is supported by the hook-shaped projection 31*b* erected on the resin holder 31. Accordingly, though the facsimile apparatus 1 may be turned upside down with the paper separating unit 10 mounted, during the manufacturing process, the separating pad 18 can be prevented from being detached or falling off from the leaf spring 32 or the resin holder 31*d*.

Further, since the leaf spring 32 is fixed to the resin holder 31, the separating pad 18 can be correctly positioned. Besides, since the leaf spring 32, the resin holder 31 and the separating pad 18 are assembled to constitute the paper separating unit 10, the paper separating unit 10 can be easily fabricated apart from the production line of the main portion of the facsimile apparatus 1, and therefore relatively small components constituting the paper separating unit 10 can be prevented from being deformed or damaged.

Further, the two plate-shaped supporting arms 32*a*, 32*b* constituting the leaf spring 32 are symmetrically located with respect to the symmetry axis L (FIG. 3D) of the separating pad 18. Accordingly, the load of the sheets of paper 3 applied to the separating pad 18 or directly to the leaf spring 32 is evenly distributed to the two plate-shaped supporting arms. Such structure, therefore, stably supports the separating pad.

Still further, the separating pad 18 is provided with the film type material 39 adhered to the predetermined region on the rear face. Accordingly, the rigidity of the separating pad 18 can be upgraded, while equally allowing the upstream-side end portion of the separating pad 18 to swing or recede into the space 40. Besides, the separating pad 18 is supported by the hook-shaped projection 31*b* as described earlier. Therefore, even though a user forcibly pulls the paper being forwarded, the separating pad 18 can be prevented from being peeled off.

Still further, the swing fulcrum P of the resin holder 31 is located on a downstream side in the feed direction from the contact interface Q between the separating pad 18 and the paper feed roller 5. Accordingly, the friction between the paper 3 and the separating pad 18 provides a momentum in a direction to press the separating pad 18 against the paper 3. As a result, the paper 3 is more firmly pressed against the separating pad 18 (and hence to the paper feed roller 5), which further ensures the prevention of the double feed.

Although the embodiment of the present invention has been described in details, it is apparent to those skilled in the art that the present invention is not limited to the foregoing embodiment, and that various modifications may be made without departing from the technical scope of the present invention.

Figure 5A:
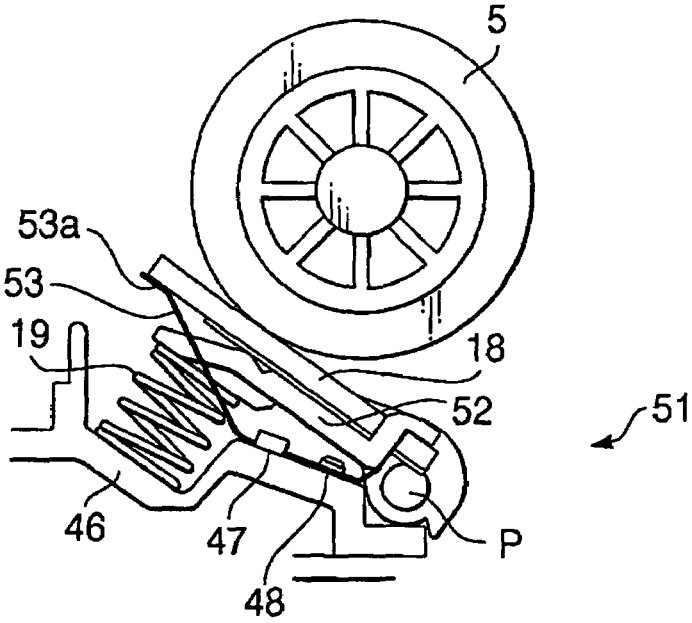
FIGS. 5A and 5B are side views showing a modified paper separating unit in accordance with aspects of the present invention.

To cite a few examples, while the leaf spring 32 is attached to the resin holder 31 in the paper separating unit 10 according to the embodiment, a leaf spring 53 may be attached to a separate supporting base 46 instead of a resin holder 52, as in a paper separating unit 51 shown in FIG. 5A. In the paper separating unit 51 shown in FIG. 5A, an end portion of the leaf spring 53 is inserted through an insertion slot 47 (of a similar structure to the insertion slots 36, 37 shown in FIG. 2C) provided on the supporting base 46, and further a fixing projection 48 formed on the supporting base 46 is inserted through fixing hole (not shown) located at the end portion of the leaf spring 53, thus to fix the leaf spring 53. The upstream-side end portion of the separating pad 18 is supported by a supporting portion 53*a* of the leaf spring 53.

Regarding the leaf spring 53 also, obviously it is preferable that a paper guide portion is provided so as to cover the upstream-side end portion of the separating pad 18, as the leaf spring 32 according to the foregoing embodiment.

Figure 5B:
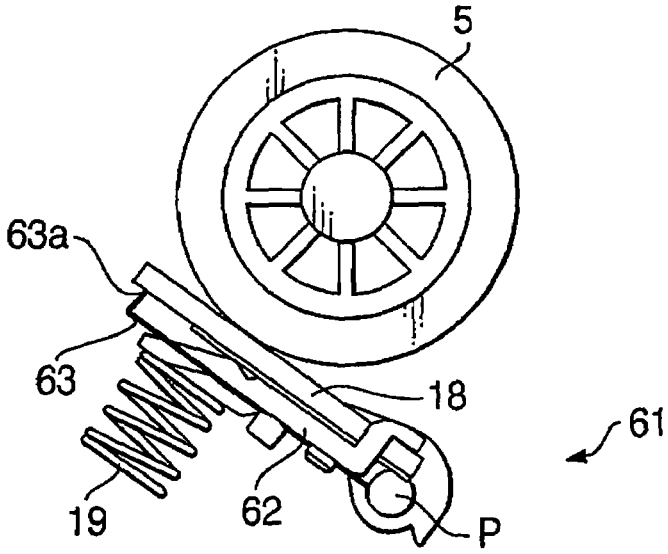

Also, a leaf spring 63 having a lateral cross-section of a reverse L shape may be fixed to a resin holder 62 as in a paper separating unit 61 shown in FIG. 5B, so as to support the vicinity of the upstream-side end portion of the separating pad 18 with a supporting portion 63*a* at an end portion of the leaf spring 63.

The paper separating unit 51 (61) configured as above also allows the upstream-side end portion of the separating pad 18 to swing because of an elastic deformation of the leaf spring 53 (63). Therefore, the double feed can be equally prevented, as in the foregoing embodiment.

Figure 6A:
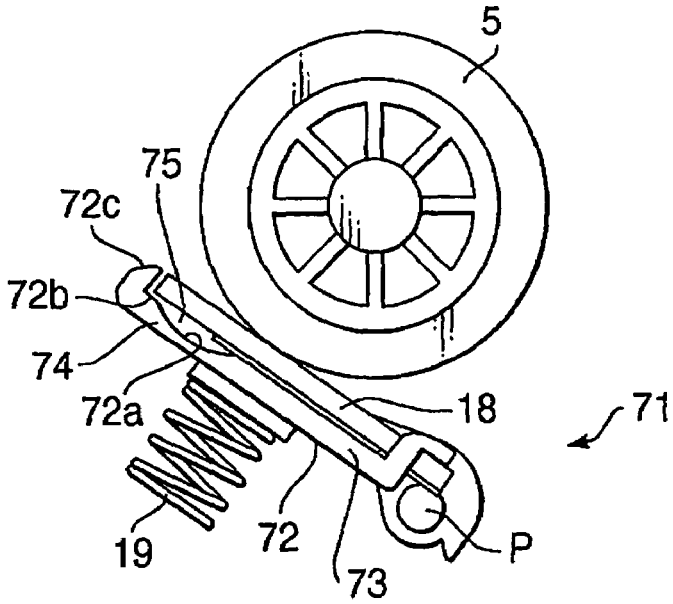
FIGS. 6A and 6B are side views showing a modified paper separating unit, without a leaf spring in accordance with aspects of the present invention.

Meanwhile, the holder can be made of a resin alone, without employing the leaf spring. Specifically, a paper separating unit 71 including a single resin holder 72 may be provided, as shown in FIG. 6A. The resin holder 72 includes a recessed portion 72*a* in a predetermined region on an upstream side in the feed direction, such that the recessed portion 72*a* defines a space 75 under the separating pad 18. The separating pad 18 is supported by a first supporting portion 73 (corresponding to the first holder member according to the present invention) located on a downstream side in the feed direction from the recessed portion 72*a* of the resin holder 72, and by a second supporting portion 74 (corresponding to the second holder member according to the present invention) located on an upstream side in the feed direction from the recessed portion 72*a* of the resin holder 72.

Here, the upstream-side end portion of the separating pad 18 is supported by a supporting portion 72*b* formed on the second supporting portion 74. Also, the second supporting portion 74 includes an inclined portion 72*c* formed so as to be inclined in a predetermined angle with respect to the pad surface. The inclined portion 72*c* performs a similar function to that of the bent portion 42 of the leaf spring 32 according to the foregoing embodiment, so as to smoothly conduct the paper 3 toward a downstream side in the feed direction, when the front edge of the paper 3 is butted to the inclined portion 72*c*.

With the paper separating unit 71 thus configured, even though the sheets of paper 3 being forwarded are directly butted to the second supporting portion 74 (more strictly, the inclined portion 72*c* thereof), the load of the sheets of paper 3 is absorbed by the recessing motion of the second supporting portion 74 about a fulcrum located close to the center of the recessed portion 72*a*. Therefore, the separating pad 18 and the paper feed roller 5 can remain pressed against each other.

Figure 6B:
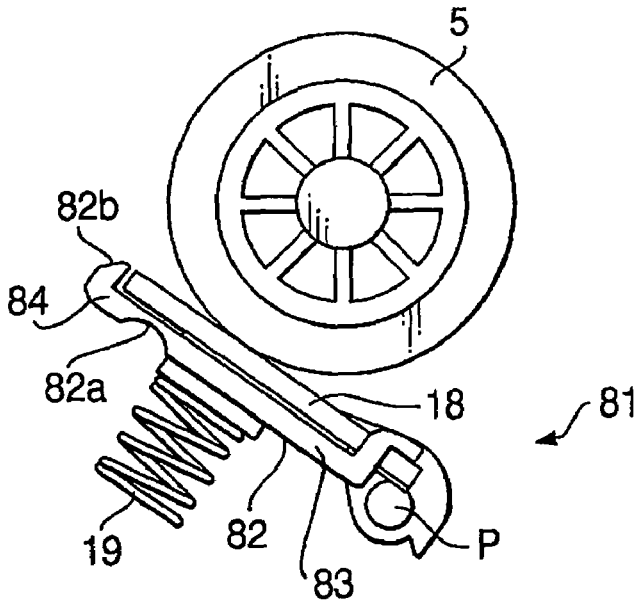
Figure 7:
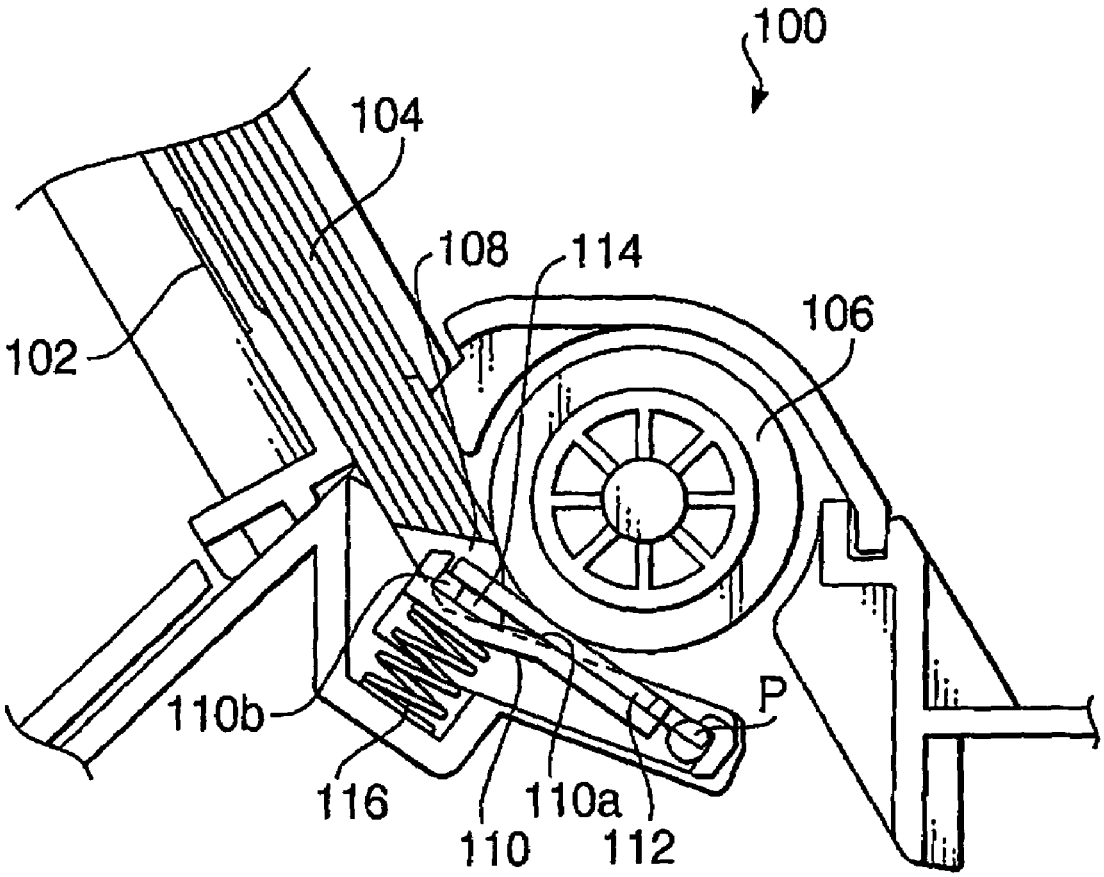
FIG. 7 is a lateral cross-sectional view showing a general structure of a conventional paper feed unit.
Figure 8A:
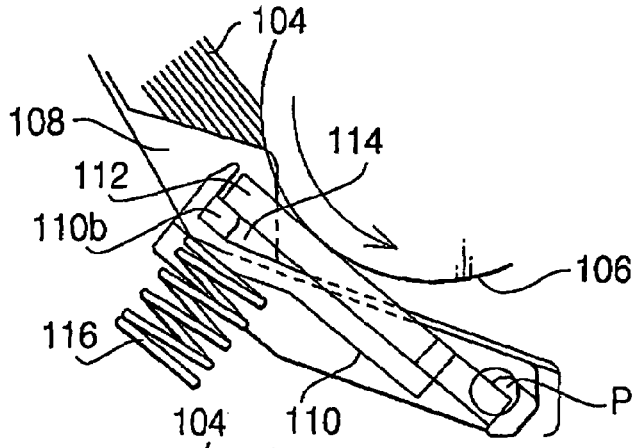
FIGS. 8A to 8D are side views showing a process of a normal paper feed operation by the paper feed unit shown in FIG. 7.
Figure 8B:
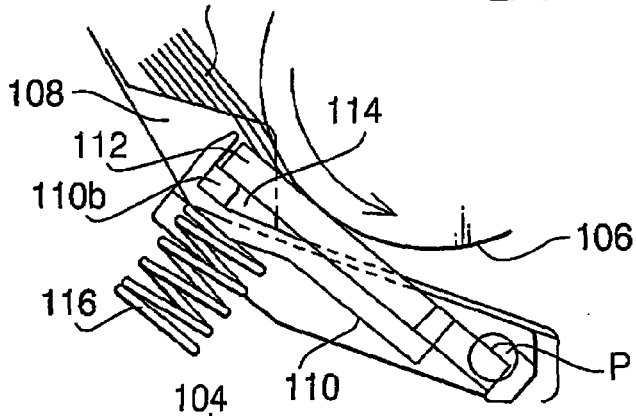
Figure 8C:
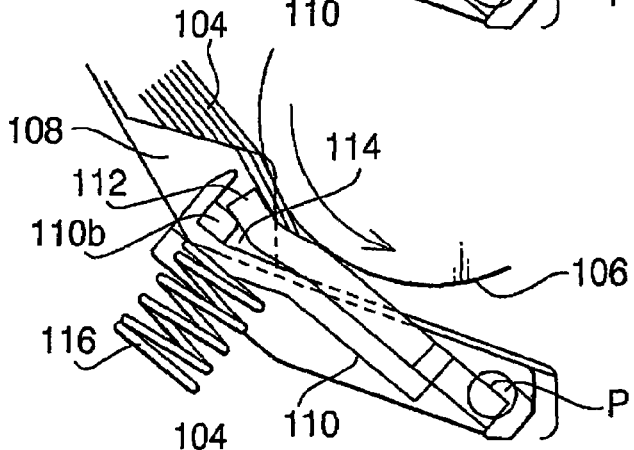
Figure 8D:
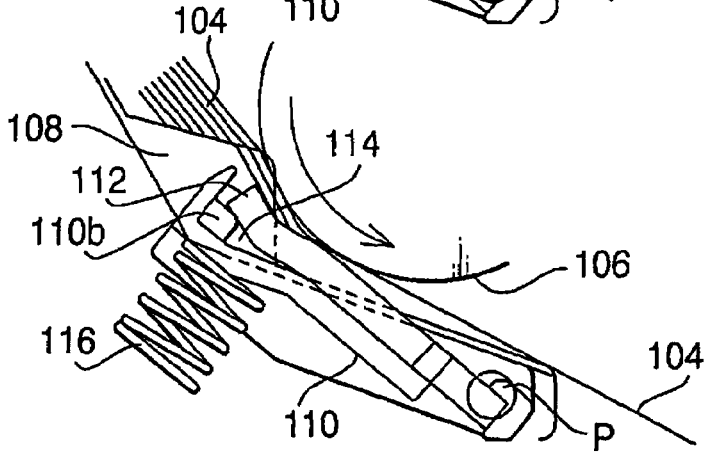
Figure 9A:
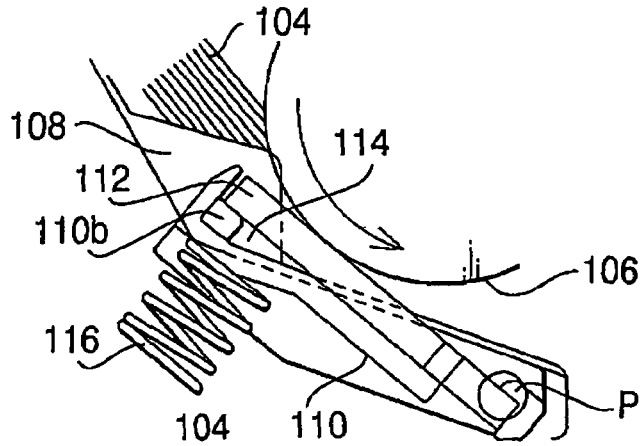
FIGS. 9A to 9D are side views showing a process of a double feed operation by the paper feed unit shown in FIG. 7.
Figure 9B:
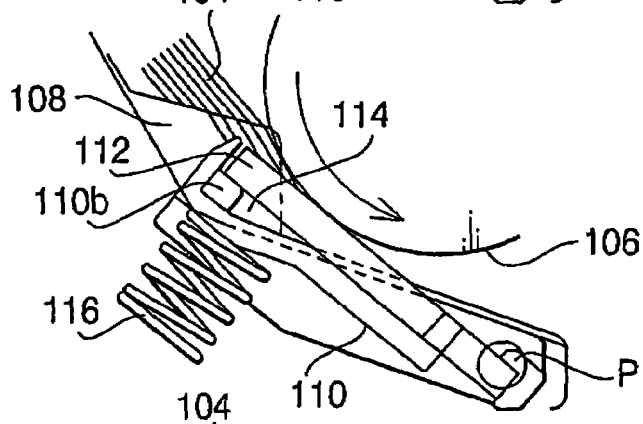
Figure 9C:
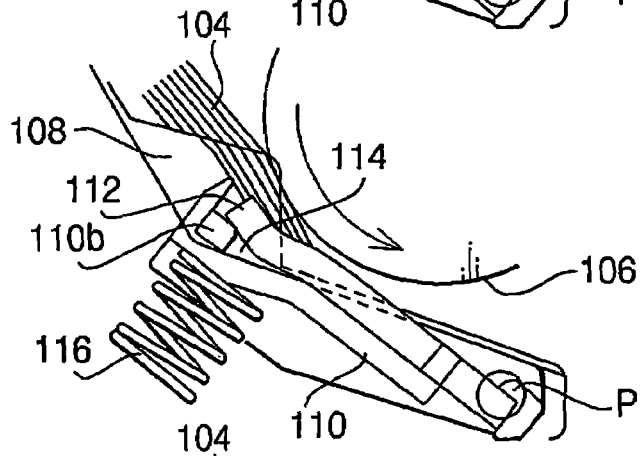
Figure 9D:
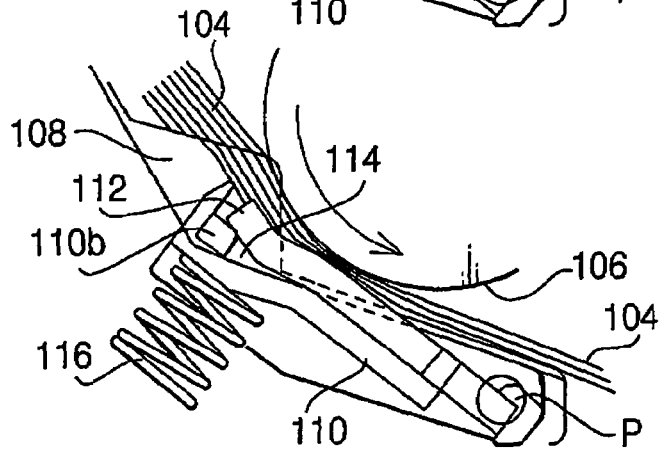

Further, a paper separating unit 81 as shown in FIG. 6B may also be provided. The paper separating unit 81 is different from the paper separating unit 71 shown in FIG. 6A only in the location of the recessed portion of the resin holder. More specifically, in the paper separating unit 71 shown in FIG. 6A, the recessed portion 72*a* is located on the face of the resin holder 72 supporting the separating pad 18, while in the paper separating unit 81 shown in FIG. 6B the recessed portion 82*a* is provided on the rear face of the resin holder 82 opposite to the face supporting the separating pad 18.

With the paper separating unit 81 thus configured also, even though the sheets of paper 3 are directly butted to the inclined portion 82*b*, the load of the sheets of paper 3 is absorbed by the recessing motion of the second supporting portion 84. However, since a space is not available under the separating pad 18, there is no room for the separating pad 18 to recede. Therefore, from the viewpoint of the separating performance, it is preferable to adopt the structure of the paper separating unit 71 shown in FIG. 6A, rather than the paper separating unit 81 shown in FIG. 6B.

Further, the bent portion 42 in the paper guide portion 32*c* of the leaf spring 32 may include an inclined portion formed in a predetermined angle with respect to the pad surface, as the inclined portion 72*c* shown in FIG. 6A, without limitation to the bent portion formed in a predetermined curvature radius as in the foregoing embodiment. The paper guide portion 32*c* thus configured can also smoothly conduct the paper engaged therewith toward a downstream side, with the effect of the inclined portion.

Still further, while the film type material 39 is adhered to the rear face of the separating pad 18 in the above embodiment, the film type material 39 is not imperatively necessary. For example, the separating pad 18 may be directly adhered to the supporting base 38 of the resin holder 31 with an adhesive or the like.

When the film type material 39 is adhered to the separating pad 18, the separating pad 18 may be placed on the supporting base 38 as it is, while it is also preferable to adhere the film type material 39 to the supporting base 38 with an adhesive, thus to more firmly fix the separating pad 18 to the supporting base 38.

Finally, the present invention may be applied to feeding a source document bearing an image to be read by a facsimile apparatus or a copier, without limitation to separating sheets of paper on which an image is to be formed and feeding the sheets of paper one by one. Applying the present invention (paper feed unit) to an image reading apparatus, designed to sequentially feed a plurality of source documents set on a source document tray one by one, and to read out the image on the source documents, allows preventing a double feed thus to feed the source documents one by one, thereby ensuring that the image on every single source document is read out without fail.

What is claimed is:

1. A paper feed unit, comprising:

a paper feed roller disposed such that an outer circumferential surface thereof contacts stacked sheets of paper so as to feed each sheet of paper by rotating;

a separating pad having elasticity configured to press a sheet of paper being forwarded by the paper feed roller against the outer circumferential surface of the paper feed roller from a side of the sheet of paper opposite to the other side contacting the outer circumferential surface of the paper feed roller;

a holder that supports the separating pad; and a biasing device that biases the holder so as to press the separating pad against the outer circumferential surface of the paper feed roller, for separating each sheet of paper from the stacked sheets by the rotation of the paper feed roller in cooperation with the separating pad and thus feeding the sheet of paper;

wherein the holder includes:

a first holder memberthat supports at least a part of a region on the separating pad from a predetermined position shifted by a predetermined distance from a contact position, at which the separating pad contacts the outer circumferential surface of the paper feed roller, toward a downstream side in a paper feed direction, to an end portion on the downstream side in the paper feed direction, and a second holder member, including a supporting portion and a pair of arms that extend in a downstream direction from the supporting portion, that supports at least an end portion of the separating pad on an upstream side in the paper feed direction or the vicinity of the upstream-side end portion of the separating pad on a side of the separating pad opposite a side of the separating pad that contacts the paper feed roller, wherein the biasing device biases the first holder member, the holder includes a space positioned between the first holder member and the separating pad and between the arms of the second holder and the separating pad, in which a predetermined region of the separating pad from the upstream-side end portion to the predetermined position is disposed so as to float, when the separating pad is attached to the holder, and the second holder member is configured to be elastically deformable so as to support elastically the separating pad.

2. The paper feed unit according to claim 1, wherein the second holder member elastically supports the separating pad so as to allow the upstream-side end portion of the separating pad to swing perpendicularly with respect to a surface of the separating pad in contact with the outer circumferential surface of the paper feed roller.

3. The paper feed unit according to claim 2, wherein the second holder member includes an elastic member having elasticity in a perpendicular direction with respect to the surface of the separating pad.

4. The paper feed unit according to claim 2, wherein the second holder member includes:

a supporting portion on which the separating pad is placed; and a hook portion located close to the upstream-side end portion of the separating pad, and perpendicularly erected with respect to the surface of the separating pad so as to cover the upstream-side end portion, wherein the hook portion has a bent portion, which is bent from the perpendicular orientation toward a downstream side in the feed direction and is bent in a predetermined curvature radius.

5. The paper feed unit according to claim 2, wherein the second holder member includes:

a supporting portion on which the separating pad is placed; and a hook portion located close to the upstream-side end portion of the separating pad, and perpendicularly erected with respect to the surface of the separating pad so as to cover the upstream-side end portion, wherein the hook portion has an inclined portion that defines a predetermined angle with respect to the surface of the separating pad.

6. The paper feed unit according to claim 1, wherein the second holder member is fixed to the first holder member.

7. The paper feed unit according to claim 2, wherein the second holder member includes a leaf spring having elasticity in a perpendicular direction with respect to the surface of the separating pad.

8. The paper feed unit according to claim 7, wherein:

the leaf spring is fixed to the first holder member at an end portion thereof, and includes two plate-shaped supporting arms extending from the end portion to an upstream side in the paper feed direction toward the upstream-side end portion of the separating padand the two plate-shaped supporting arms are generally symmetrically disposed with respect to a symmetry axis of the separating pad in the paper feed direction.

9. The paper feed unit according to claim 1, wherein the first holder member is made of a resin.

10. The paper feed unit according to claim 1, wherein:

the first holder member includes a supporting base on which the separating pad is placed; and the separating pad is adhesively attached to the supporting base, directly or via a film type material that serves to enhance rigidity of the separating pad.

11. The paper feed unit according to claim 1, wherein the first holder member includes a swing fulcrum located on a downstream side in the paper feed direction from the contact position of the separating pad and the paper feed roller, so that the first holder member can swing so as to locate the separating pad close to or spaced from the paper feed roller.

12. An image forming apparatus, comprising:

the paper feed unit according to claim 1; and an image forming unit that forms an image on a sheet of paper fed by the paper feed unit.

13. A paper feed unit, comprising:

a paper feed roller disposed such that an outer circumferential surface thereof contacts stacked sheets of paper so as to feed each sheet of paper by rotating;

a separating pad having elasticity configured to press a sheet of paper being forwarded by the paper feed roller against the outer circumferential surface of the paper feed roller from a side of the sheet of paper opposite to the other side contacting the outer circumferential surface of the paper feed roller;

a holder that supports the separating pad; and a biasing device that biases the holder so as to press the separating pad against the outer circumferential surface of the paper feed roller, for separating each sheet of paper from the stacked sheets by the rotation of the paper feed roller in cooperation with the separating pad and thus feeding the sheet of paper, wherein the holder has a recessed portion located on an upstream side in a paper feed direction with respect to all positions at which the separating pad contacts the outer circumferential surface of the paper feed roller and downstream of an upstream-side end portion of the holder that is in contact with a side of the separating pad opposite a side of the separating pad that contacts the paper feed roller so that the upstream-side end portion of the holder can swing with respect to a position of the recessed portion, and the recessed portion defines a space adjacent the holder.

14. The paper feed unit according to claim 13, wherein the recessed portion is formed on a surface of the holder facing the separating pad so that the space is formed between the separating pad and the recessed portion of the holder.

15. The paper feed unit according to claim 13, wherein the recessed portion is formed on a surface of the holder opposite to the other surface facing the separating pad.

16. The paper feed unit according to claim 13, wherein the recessed portion has a thickness smaller than that of the other portion of the holder.

17. An image forming apparatus, comprising:

the paper feed unit according to claim 13; and an image forming unit that forms an image on a sheet of paper fed by the paper feed unit.

18. A paper separating unit used in a paper feed unit having a paper feed roller and a biasing device for separating each sheet of paper from stacked sheets by rotation of the paper feed roller, comprising:

a separating pad having elasticity configured to press a sheet of paper being forwarded by the paper feed roller against an outer circumferential surface of the paper feed roller from a side of the sheet of paper opposite to the other side contacting the outer circumferential surface of the paper feed roller; and a holder that supports the separating pad, wherein the holder includes:

a first holder member that supports at least a part of a region on the separating pad from a predetermined position shifted by a predetermined distance from a contact position, at which the separating pad contacts the outer circumferential surface of the paper feed roller, toward a downstream side in a paper feed direction, to an end portion on the downstream side in the paper feed direction;

a second holder member, including a supporting portion and a pair of arms that extend in a downstream direction from the supporting portion, that supports at least an end portion of the separating pad on an upstream side in the paper feed direction or the vicinity of the upstream-side end portion of the separating pad on a side of the separating pad opposite a side of the separating pad that contacts the paper feed roller, the second holder member being configured to be elastically deformable so as to support elastically the separating pad; and a space positioned between the first holder member and the separating pad and between the arms of the second holder and the separating pad, in which a predetermined region of the separating pad from the upstream-side end portion to the predetermined position is disposed so as to float, when the separating pad is attached to the holder.

19. The paper separating unit according to claim 18, wherein the second holder member elastically supports the separating pad so as to allow the upstream-side end portion of the separating pad to swing perpendicular with respect to a surface of the separating pad in contact with the outer circumferential surface of the paper feed roller.

20. A paper separating unit used in a paper feed unit having a paper feed roller and a biasing device for separating each sheet of paper from stacked sheets by rotation of the paper feed roller, comprising:

a separating pad having elasticity configured to press a sheet of paper being forwarded by the paper feed roller against the outer circumferential surface of the paper feed roller from a side of the sheet of paper opposite to the other side contacting the outer circumferential surface of the paper feed roller; and a holder that supports the separating pad, wherein the holder has a recessed portion located on an upstream side in a paper feed direction with respect to a contact position at which the separating pad contacts the outer circumferential surface of the paper feed roller and downstream of an upstream-side end portion of the holder that is in contact with a side of the separating pad opposite a side of the separating pad that contacts the paper feed roller so that the upstream-side end portion of the holder can swing with respect to a position of the recessed portion, and the recessed portion defines a space adjacent the holder.

21. A paper separating unit used in a paper feed unit having a paper feed roller and a biasing device for separating each sheet of paper from stacked sheets by rotation of the paper feed roller, comprising:

means for separating, said means for separating having elasticity, configured to press a sheet of paper being forwarded by the paper feed roller against the outer circumferential surface of the paper feed roller from a side of the sheet of paper opposite to the other side contacting the outer circumferential surface of the paper feed roller; and holding means for supporting the means for separating, wherein the holding means has a recessed portion located on an upstream side in a paper feed direction with respect to a contact position at which the means for separating contacts the outer circumferential surface of the paper feed roller and downstream of an upstream-side end portion of the holding means that is in contact with a side of the means for separating opposite a side of the means for separating that contacts the paper feed roller so the upstream-side end portion of the holding means can swing with respect to a position of the recessed portion, and the recessed portion defines a space adjacent the holder.

* * * * *